United States Patent [19]

Yokoyama

[11] Patent Number: 4,797,986

[45] Date of Patent: Jan. 17, 1989

[54] SPUR GEAR MANUFACTURING PROCESS

[75] Inventor: Michihiro Yokoyama, Anjyo, Japan

[73] Assignee: Kabushiki Kaisha Yokoyama Seisakusho, Anjo, Japan

[21] Appl. No.: 63,472

[22] Filed: Jun. 18, 1987

[30] Foreign Application Priority Data

Jun. 20, 1986 [JP] Japan ..... 61-145094

[51] Int. Cl.[4] ..... B21D 53/28

[52] U.S. Cl. ..... 29/159.2; 72/356

[58] Field of Search ..... 29/159.2; 72/356, 359

[56] References Cited

U.S. PATENT DOCUMENTS

| | | | |
|---|---|---|---|
| 521,178 | 6/1894 | Porter | 29/159.2 |
| 2,542,912 | 2/1951 | Ensign | 29/159.2 X |
| 4,050,283 | 9/1977 | Schober | 29/159.2 X |
| 4,111,031 | 9/1978 | Vennemeyer et al. | 72/359 |
| 4,290,292 | 9/1981 | Yoneda | 72/356 X |
| 4,509,353 | 4/1985 | Ike et al. | 72/263 |

FOREIGN PATENT DOCUMENTS

| | | | |
|---|---|---|---|
| 49-79945 | 8/1974 | Japan . | |
| 58-47929 | 10/1983 | Japan . | |
| 60-37237 | 2/1985 | Japan | 29/159.2 |
| 618172 | 6/1978 | U.S.S.R. | 29/159.2 |
| 978997 | 12/1982 | U.S.S.R. | 72/356 |

*Primary Examiner*—P. W. Echols
*Assistant Examiner*—Andrew E. Rawlins
*Attorney, Agent, or Firm*—Burns, Doane, Swecker & Mathis

[57] ABSTRACT

The present invention discloses a manufacturing process whereby a spur gear is cold-press molded. By means of the invention a pre-punched workpiece is loaded on a counter which is admitted to a bore in a female die having a chamfer at its inlet, pressure is applied on the workpiece through the bore in the female die by means of a punch when pressure is increased from below so as to lift the counter from the counter plate, a primary product is formed by means of causing said workpiece to descend so as to transit the chamfer, extracting said primary product from the female die and reversing its orientation top to bottom, and repeating the identical process once again.

1 Claim, 3 Drawing Sheets

SPUR GEAR MANUFACTURING PROCESS

BACKGROUND OF THE INVENTION

The present invention relates to a process for cold-press molding spur gears.

DESCRIPTION OF THE PRIOR ART

Conventionally, the prevalent methods for press-molding spur gears include processes by hot forging, but problems arise from the lack of precise control over the temperature of the workpiece which prevents the manufacture of high precision spur gears. In addition, when spur gears are manufactured by forging, the outer diameter of the workpiece is molded, via the punch pressure, in such a way so as to conform to the protruding tooth profile of the molding die, however, under high pressure the outer diameter of said punch becomes finely worn within a short period and cannot produce high precision spur gears on a long-term basis. Thus, spur gears are also cold-press molded, however, a so-called closure is produced at the frontal edge in the direction of extrusion molding and the exterior of the spur gear anterior edge tends to become smaller while the external diameter of the posterior edge tends to becomes larger. Also, cracks may easily form in the tooth profile as die wear occurs on the posterior edge due to extraction of the press. Although an invention is disclosed in Tokkai No. Sho-58-47929 wherein were combined extrusion molding via a rough forming die and extrusion molding via a finishing impression, the process requires large-scale presses and the punches have a limited life span. Furthermore, a process employing a precision punch press requires an expensive and specialized press machine wherein some degree of closure will occur to the anterior and posterior surfaces of the spur gear.

SUMMARY OF THE INVENTION

An object of the present invention is to provide a process for the manufacture of high precision spur gears without requiring the use of a costly specialized press machine.

To accomplish the aforesaid object, the present invention provides a process for the manufacture of spur gears which comprises loading a pre-punched workpiece on a counter which is admitted to a bore in a female die having a chamfer at its inlet, applying pressure on the workpiece through the bore in the female die by means of a punch when pressure is increased from below so as to lift said counter from the counter plate, forming the primary product by means of causing said workpiece to descend so as to transit the chamfer, extracting said primary product from the female die and reversing its orientation, and repeating the identical process once again.

According to the aforesaid construction, a primary product is obtained via the first process wherein a fine taper is effected at the anterior edge and a full taper at the posterior edge of the workpiece, and via the second process further tapering is performed and a spur gear is produced having a gear molded with high precision over the entire thickness of the material.

Other and further objects, features and advantages of the invention will become more fully apparent from the following description.

DETAILED DESCRIPTION OF THE PREFERRED EMBODIMENTS

The manufacturing process of the present invention as well as an embodiment of the device for manufacturing the spur gear by said process are hereinafter described.

Figure 1:
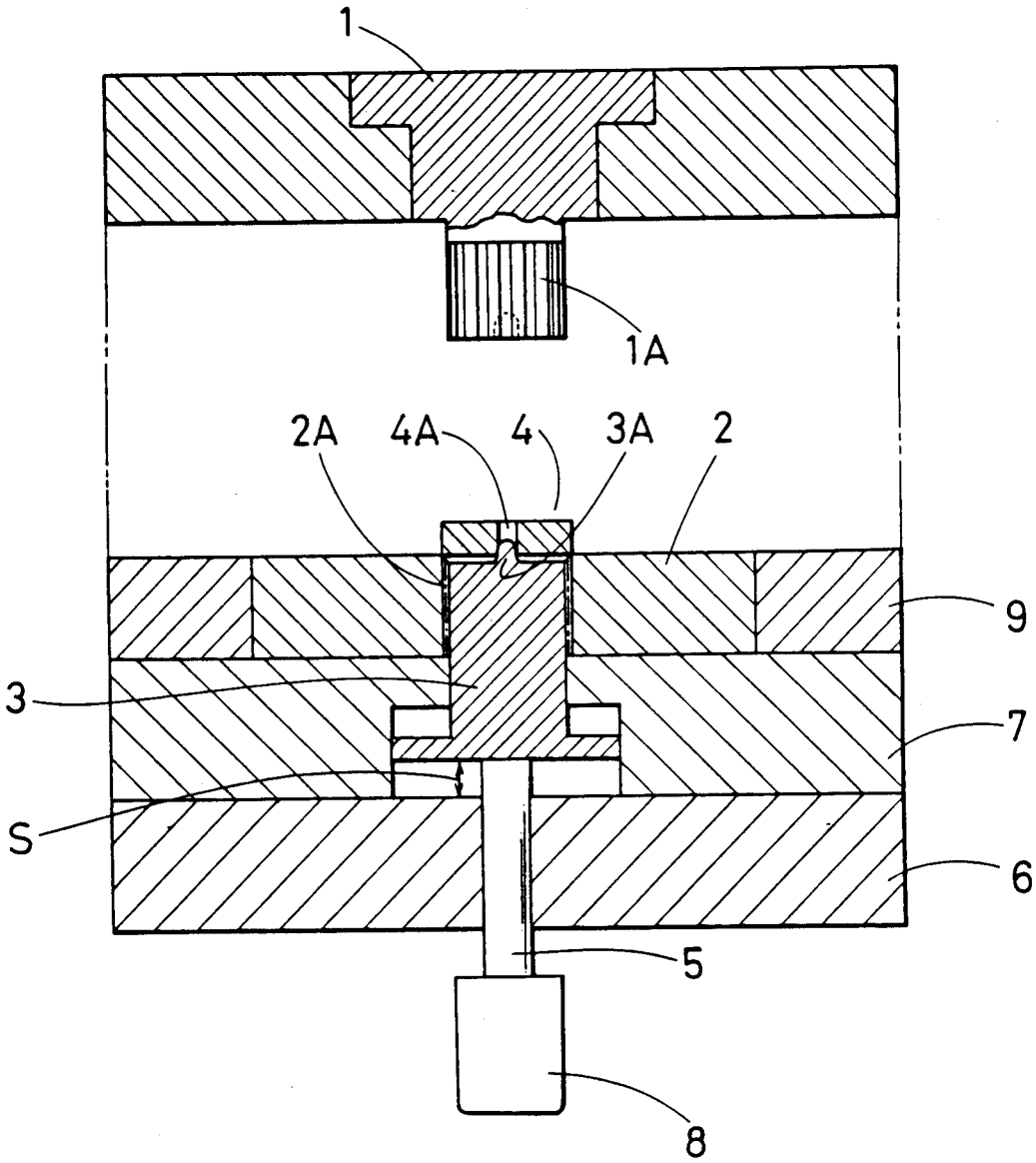
FIG. 1 is a cross sectional plan view showing an example of the device for manufacturing spur gears by means of the processes of the present invention.

The tooth profile lA is formed on the exterior surface of punch 1 as shown in FIG. 1. Also, tooth profile 2A having the required modular form is formed on the interior surface of female die 2 positioned on counter plate 6 via wear plate 7. Counter 3 is admitted to the interior diameter of female die 2 so as to receive workpiece 4, and the length of counter 3 is determined so as to provide the lower surface of said counter 3 and the upper surface of counter plate 6 with a space S situated therebetween. The length of space S is set at a value whereby counter 3 will not make contact with counter plate 6 even when said counter 3 reaches the end point of descent. Ejector pin 5 contacts the lower surface of counter 3, and to the bottom segment of said ejector pin 5 is provided a pressure device 8 capable of two-stage switching. Ejector pin 5 moves upward by means of pressure device 8 which normally provides a reasonable pressure of approximately 2–5 t, and when workpiece 4, which becomes the hereinafter described primary product 40, is extracted from female die 2 the pressure from said pressure device 8 can be increased greatly, some 5–10 fold. In addition, female die 2 is shrinkage fitted to reinforcement ring 9. The press machine used in the present embodiment is of a typical type reconstructed only in that pressure device 8 is provided thereto.

Figure 2:
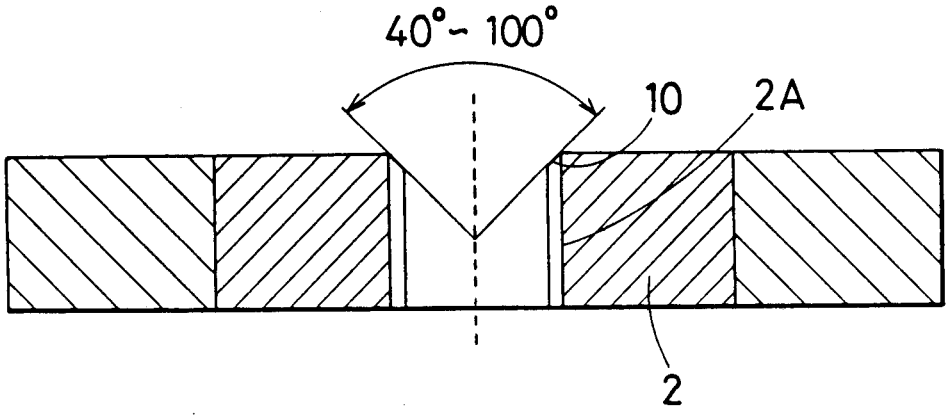
FIG. 2 is a cross sectional plan view showing an enlargement of the female die in said device.

A 40°–100° chamfer 10 is achieved with uniformity around the entire circumference of female die 2 as shown in FIG. 2 in order to markedly reduce the frictional resistance at the inlet to female die 2 because female die 2 or punch 1 can be easily damaged due to the great force exerted when the tooth profile is formed at the inlet to female die 2, also chamfer 10 must be attached to both the vertical and horizontal surfaces of female die 2 via the minutely curved surface of the diameter. Because the angle of chamfer 10 may be changed according to the thickness of the workpiece 4, appropriate angles in the range of 40°–100° can be determined through experimentation. Also, in order to avoid a concentration of pressure, it is desirable that chamfering 10 and the minutely curved surface be specially mirrored surfaces.

(Operation)

In the aforementioned construction, in order to manufacture a spur gear by means of the process of the present embodiment, precision punch-pressed workpiece 4 is provided via a special process. In the present embodiment, a shaft bore 4A is provided in the center of workpiece 4. First, workpiece 4 is placed on counter 3. Positioning of workpiece 4 is accomplished by placing the shaft bore 4A of workpiece 4 on the shaft 3A of counter 3. When the upper mold descends, workpiece 4 is acted upon both by a downward pressure from above by descending punch 1 and by an upward pressure from below by counter 3, workpiece 4 being situated therebetween, whereupon workpiece 4 is pushed by great force from above via punch 1 and is admitted to female die 2 since the downward pressure exerted from above by punch 1 is greater than the upward pressure exerted from below by counter 3. At this point, although a great force acts upon the inlet of female die 2, workpiece 4 transits chamfer 10 with relatively slight frictional resistance because chamfer 10 is provided at the inlet of female die 2 and connected thereto via a curved surface as shown in FIG. 2. Workpiece 4 transits completely through chamfer 10 of female die 2, is pressed completely into female die 2, and punch 1 descends to a point 40% or more of the thickness of workpiece 4. A relatively slow rate of descent for punch 1 is most suitable for the molding of the tooth profile. At such time as punch 1 attains the end point of descent, the lower surface of counter 3 makes contact with the upper surface of counter plate 6 via the force imparted by said punch 1, and since punch 1 can be easily damaged should sufficient force be applied, the aforesaid space S is provided in order that such damage may be avoided and assure there is no contact between counter 3 ad counter plate 6. Punch 1 is raised after attaining the end point of descent. Thereupon, counter 3 raises workpiece 4 with the tooth profile molded thereon (primary product 40) and the first process is completed. Ejector pin 5 which pushes counter 3 in an upward direction normally provides sufficient upward force, but when a large frictional resistance is generated on the lateral surface of female die 2 due to both the thickness of workpiece 4 and the variance of the modular form of the primary product tooth profile as shown in FIG. 3, ejector pin 5 is raised by means of a large pressure supplied by pressure device 8 having a two-stage switching capability because at such times ejector pin 5 requires 5–10 fold greater pressure for the rising movement than is necessary for the descending movement.

Figure 3:
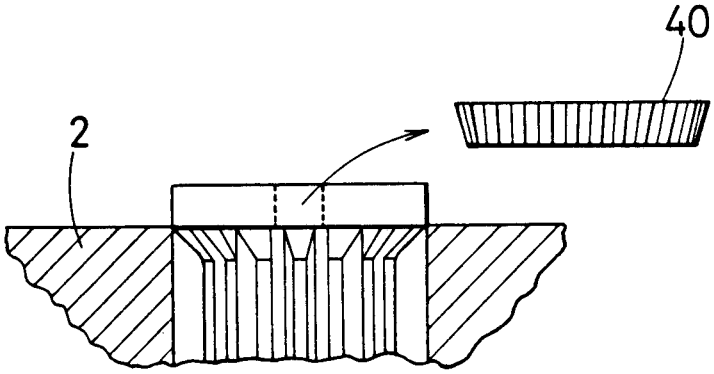
FIG. 3 is a cross sectional plan view showing the female die and the primary product produced in the first process.
Figure 4:
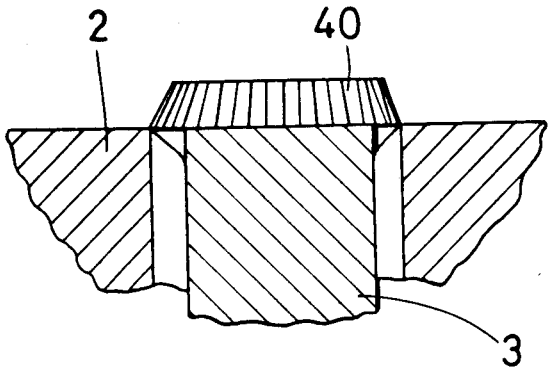
FIG. 4 is a cross sectional plan view illustrating the second process.

A high precision spur gear is difficult to fabricate because primary product 40 bearing a tooth profile formed thereon via the aforementioned first process has a trimming taper as shown in FIG. 3. Thus, the orientation of primary product 40 is reversed top to bottom, said primary product 40 is repositioned on counter 3 as shown in FIG. 4, and thereafter in an identical manner to that of the first process pressure is increased above and below by the punch and the counter whereby said primary product 40 is lowered into female die 2 via the great pressure exerted by the punch, the second process is performed to remove the trimming taper, and a high precision spur gear 50 with the trimming taper removed is manufactured as shown in FIG. 5.

(Example of Numerical Performance)

Figure 5:
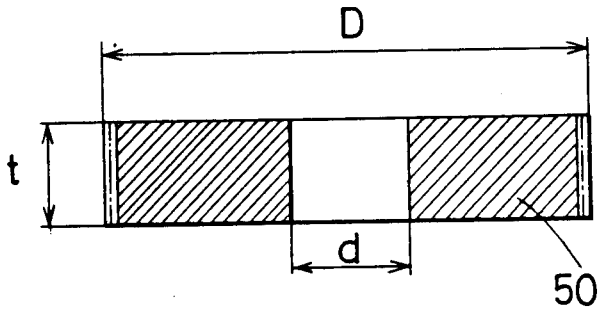
FIG. 5 is a cross sectional plan view showing the completed spur gear.

A high precision spur gear which meets the JIS (Japanese Industrial Standards) fourth class requirements can be manufactured by means of the aforementioned process, said spur gear having an outer diameter D of 30 mm, inner diameter d of 6 mm and length t of 6 mm as shown in FIG. 5. Surprisingly high precision spur gears are produced which can even be used for automobile transmission gears where normal requirements are JIS 6–7 class.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A manufacturing process for cold-press molding spur gears which comprises:

(a) loading a pre-punched workpiece having a top to bottom orientation on a counter which is located in a bore of a female die, said bore having a chamfer at one end and a tooth profile located on an interior portion of said bore;

(b) pressing the workpiece completely through the chamfer with a punch such that the punch descends into the die only part of the way through the die so that said counter does not make contact with a counter plate, said pressing step producing a primary product;

(c) extracting the primary product from the female die with the counter and reversing the counter's top to bottom orientation, thereby completing a first step;

(d) loading said primary product on the counter, pressing the primary product with the punch into the female die and thereafter, removing a resultant high precision spur gear from the die with the counter.

* * * * *